US011639552B2

(12) United States Patent
LaVallee

(10) Patent No.: US 11,639,552 B2
(45) Date of Patent: May 2, 2023

(54) METHOD FOR CREATING MULTIPLE ELECTRICAL CURRENT PATHWAYS ON A WORK PIECE

(71) Applicant: LACKS ENTERPRISES, INC., Grand Rapids, MI (US)

(72) Inventor: Michael LaVallee, Grand Rapids, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 136 days.

(21) Appl. No.: 16/679,635

(22) Filed: Nov. 11, 2019

(65) Prior Publication Data

US 2020/0071844 A1 Mar. 5, 2020

Related U.S. Application Data

(63) Continuation-in-part of application No. 14/712,702, filed on May 14, 2015.

(51) Int. Cl.

| | |
|---|---|
| ***C23C 18/16*** | (2006.01) |
| ***C25D 5/02*** | (2006.01) |
| ***C25D 3/04*** | (2006.01) |
| ***C25D 5/56*** | (2006.01) |
| ***C25D 5/00*** | (2006.01) |
| ***C25D 5/12*** | (2006.01) |
| ***C25D 5/14*** | (2006.01) |

(52) U.S. Cl.

CPC ..... *C23C 18/1653* (2013.01); *C25D 3/04* (2013.01); *C25D 5/022* (2013.01); *C25D 5/12* (2013.01); *C25D 5/14* (2013.01); *C25D 5/56* (2013.01); *C25D 5/627* (2020.08)

(58) Field of Classification Search

None

See application file for complete search history.

(56) References Cited

U.S. PATENT DOCUMENTS 1,985,308 A * 12/1934 Bornhauser ..... C25D 3/04 205/285
3,470,082 A * 9/1969 Raymond ..... C25D 17/10 204/230.6
3,772,162 A 11/1973 Grune
(Continued)

FOREIGN PATENT DOCUMENTS

DE 102007009583 A1 8/2008
DE 102007052849 A1 5/2009
JP S59126790 A1 7/1984

*Primary Examiner* — Louis J Rufo

(74) *Attorney, Agent, or Firm* — Dickinson Wright PLLC

(57) ABSTRACT

A method for plating a work piece includes forming a work piece, where the work piece includes first and second segments that are electrically isolated. The first segment is connected in a first circuit and the second segment is connected in a second circuit. The first circuit may include a first power source and the second circuit may include a second power source. The work piece and the first and second segments may be disposed in a common solution, and current may be applied in the first circuit and the second circuit to create first and second metal surfaces. The first and second metal surfaces may be made from the same base metal. The first and second metal surfaces may be created simultaneously, with the work piece and the first and second segments disposed in a common solution.

20 Claims, 4 Drawing Sheets

(56) References Cited

U.S. PATENT DOCUMENTS

| | | | | |
|---|---|---|---|---|
| 4,999,094 | A * | 3/1991 | Kamamori | C25D 13/00<br>204/484 |
| 2002/0197492 | A1* | 12/2002 | Hao | C25D 5/56<br>428/457 |
| 2004/0007471 | A1* | 1/2004 | Phu | C25D 5/56<br>205/122 |
| 2006/0222824 | A1* | 10/2006 | Yasuhara | H01H 13/14<br>428/195.1 |
| 2019/0032235 | A1* | 1/2019 | Hashimoto | C23C 18/30 |

* cited by examiner

METHOD FOR CREATING MULTIPLE ELECTRICAL CURRENT PATHWAYS ON A WORK PIECE

CROSS-REFERENCE TO RELATED APPLICATIONS

This application is a continuation-in-part of co-pending U.S. patent application Ser. No. 14/712,702, filed May 14, 2015, titled "Method for Creating Multiple Electrical Current Pathways on a Work Piece," the entire content of which is hereby incorporated by reference in its entirety.

TECHNICAL FIELD

The present disclosure relates generally to improved aesthetics for work pieces, including by a method of electroplating. More specifically, the present disclosure relates to a method for creating multiple electrical current pathways on a work piece to allow for the presence of multiple separate finishes on a single plastic work piece.

BACKGROUND OF THE DISCLOSURE

Plated decorative chrome finishes have long been available for various products in the automotive, appliance, consumer electronics, and household application industries. Variations in the deposition methods, processing conditions, and solution makeup of the various types of metals have subsequently resulted in aesthetic variations in the final product. These variations in processing, chemical, and deposition techniques are able to generate different color metal finishes, lower gloss levels, and less distinction of image (DOI) in the metal finish of work pieces all with an eye to improving aesthetics. Examples of these finishes include but are not limited to Bright Chrome, Black Nickel, Black Chrome, and the like. Another exemplary finish that has been employed is Satin Chrome, which involves varying the reflectivity of the underlying metal layer such as by creating more pits in the substrate surface. Varying the degree of reflectivity allows for many different types of metal finishes. Often, these variations are combined with a bright chromium finish in assemblies to 1) complement each other and 2) bring more aesthetic appeal to the final product.

A known method of finishing work pieces to provide a final product that has multiple distinct surface finishes includes utilizing work piece assemblies that are made up of multiple components, each having a different metal finish and which are assembled to form the final product. This practice, while effective, results in multiple operations and multiple sets of tooling which adds significant cost to the final product.

Another known method of finishing work pieces to provide a final product that has multiple distinct surface finishes includes applying bright and satin-like finishing to the surface of the work piece with masking and pre or post surface treatments using abrasive grains such as iron powder, glass powder, silicon oxide, alumina and the like. Molded in texture or surface effects have also been employed to create variation in the metal finish of the work piece by selectively incorporating the texture or surface finish into a portion of the work piece prior to application of a metal finish. However, when such work pieces, which include one section employing these surface effects and another part without these effects, are both subjected to electroplating, the leveling characteristic of the electroplated layer on these two sections does not create the visual effect of two distinct metal surface finishes as desired. Also, the pre and post surface treatments are costly and require an additional operation.

Vacuum metallization and chemical vapor deposition techniques are able to achieve a final product that has segments with different finishes, but are very costly and limited from a performance standpoint in many environments because of the thin layer of metal that results from these techniques. Additionally, physical vapor deposition coatings must include an organic coating thereover to protect the deposited metal layer. This additional step increases labor costs and creates an "orange peel" look due to the fact that the organic coating is not completely smooth.

Another method of creating two distinct surface effects on a work piece includes masking and painting using tinted basecoats and clear coats. Although this method creates the desired effect, it disadvantageously requires an additional painting operation which adds cost to the final product.

In view of the above, there remains a need for improved methods of treating work pieces that provide for a final product that includes more than one surface finish on a single work piece. More specifically, there remains a need for a method which offers more degrees of flexibility to designers and manufacturers with regards to its aesthetic effects while reducing the overall part and manufacturing costs by eliminating secondary operations.

SUMMARY OF THE DISCLOSURE

A method for plating a plastic work piece using a power source having a positive terminal and a negative terminal is provided. The method includes applying an electroless layer of material to the work piece using an electroless plating process. The positive terminal of the power source may be connected to a first anode and the negative terminal of the power source may be connected to the work piece. The work piece can then be immersed in a first aqueous solution that contains the first anode. The first anode may then be positively charged and the work piece may be negatively charged to cause metal ions in the first aqueous solution to be passed onto the electroless layer of the work piece.

The method can further include creating at least one barrier in electrical conductivity in the work piece prior to the step of immersing the work piece in a first aqueous solution to divide the work piece into at least a first segment and a second segment which are substantially electrically insulated from one another.

The negative terminal of the power source can also be connected to the second segment of the work piece. The method may also include immersing the work piece in a second aqueous solution that contains a second anode. Once the work piece is immersed in the second aqueous solution, the second anode can be positively charged and a second negative charge may be applied to the second segment of the work piece to cause metal ions from the second aqueous solution to be passed onto the electroless layer of only the second section of the work piece to form a second electroplated layer on the second segment of the work piece.

It is therefore an aspect of the present disclosure to provide a method for plating a work piece with multiple surface finishes. The method eliminates the need for costly secondary operations to finish the work piece since creating the barrier in electrical conductivity and respectively electroplating the first and second segments of the work piece may be done in an inexpensive and simple process.

In one aspect, a method of creating a part having multiple decorative surfaces is provided, comprising: forming a plastic work piece of a first material; creating at least one barrier in electrical conductivity in the work piece to divide the work piece into multiple electrically isolated segments including a first segment and a second segment; connecting a first segment of the work piece to a first circuit including a first power source; connecting a second segment of the work piece to a second circuit including a second power source; creating a first metal surface of the work piece on the first segment via a plating process; creating a second metal surface of the work piece on the second segment via a plating process; wherein the first and second metal surfaces of the work piece have different surface finishes; wherein the first and metal surfaces are created from the same base metal and a common solution.

In one aspect, the first metal surface includes multiple layers and the second metal surface includes multiple layers.

In a related aspect, the first and second metal surfaces each include multiple metal layers.

In one aspect, the method includes disposing the first and second segments in a common electroless solution prior to creating the first and second metal surfaces.

In one aspect, at least one layer of the first and second metal surfaces are created simultaneously from a common solution.

According to a related aspect, distinctive metal layers of the first and second metal surfaces are created simultaneously.

In one aspect, the first and second metal surfaces are created sequentially from a common solution.

In one aspect, the work piece remains in the common solution during the creation of the first and second metal surfaces.

In one aspect, where the first and second metal surfaces have common layers and the process includes a single rectifier that is used to create the common layers.

According to another aspect, the process involves dual rectifiers associated with each tank for the deposition of the metal layers.

In one aspect, the first power source produces a first type of surface finish and the second power source produces a second type of surface finish.

In one aspect, the method includes applying an electroless layer of material to the first and second segments of the work piece and rendering the first and second segments conductive.

In one aspect, the method includes creating a non-plateable barrier between the first and second segments of the work piece.

In another aspect, a method of creating a part having multiple decorative surfaces is provided, comprising: forming a plastic work piece; rendering a first segment and a second segment of the work piece conductive, wherein the first and second segments are electrically isolated relative to each other; creating a first metal surface on the first segment of the plastic work piece through a plating process that includes applying a first current via a first circuit that includes the first segment; creating a second metal surface on the second segment of the plastic work piece through a plating process that includes applying a second current via a second circuit that includes the second segment; wherein the first metal surface the second metal surface have the same base metal; wherein the first and second current are applied simultaneously to create at least one layer of the first and second metal surfaces simultaneously. The method additionally includes applying only the first current to form one or more additional metal layers on the first segment. The method can further include subsequently applying only the second current to form one or more additional metal layers on the second segment.

In one aspect, the first circuit includes a first power source and the second circuit includes a second power source.

In one aspect, the first metal surface is Bright Chrome and the second metal surface is different whereby the work piece has multiple different surface appearances.

In one aspect, the work piece and the first and second segments are disposed in a common solution during the creation of the first and second surfaces.

In one aspect, the first and second currents are different.

In one aspect, the first and second circuits are connected to different rectifiers.

In one aspect, the first metal surface includes multiple layers and the second metal surface includes multiple layers.

In one aspect, the method includes disposing the work piece and the first and second segments in a common solution having the base metal, wherein the first and second metal surfaces are created without removing the work piece from the common solution during the creation of the first and second metal surfaces.

In one aspect, the method includes forming at least one barrier in electrical conductivity in the work piece to divide the work piece into the first and second segments.

In one aspect, the at least one barrier is formed of a material that substantially prevents an electroless layer of material being formed thereon, and the step of rendering the first and second segments conductive includes applying an electroless layer of material on the first segment and the second segment.

BRIEF DESCRIPTION OF THE DRAWINGS

Other aspects of the present disclosure will be readily appreciated, as the same becomes better understood by reference to the following detailed description when considered in connection with the accompanying drawings wherein.

DESCRIPTION OF THE PREFERRED EMBODIMENTS

Figure 1:
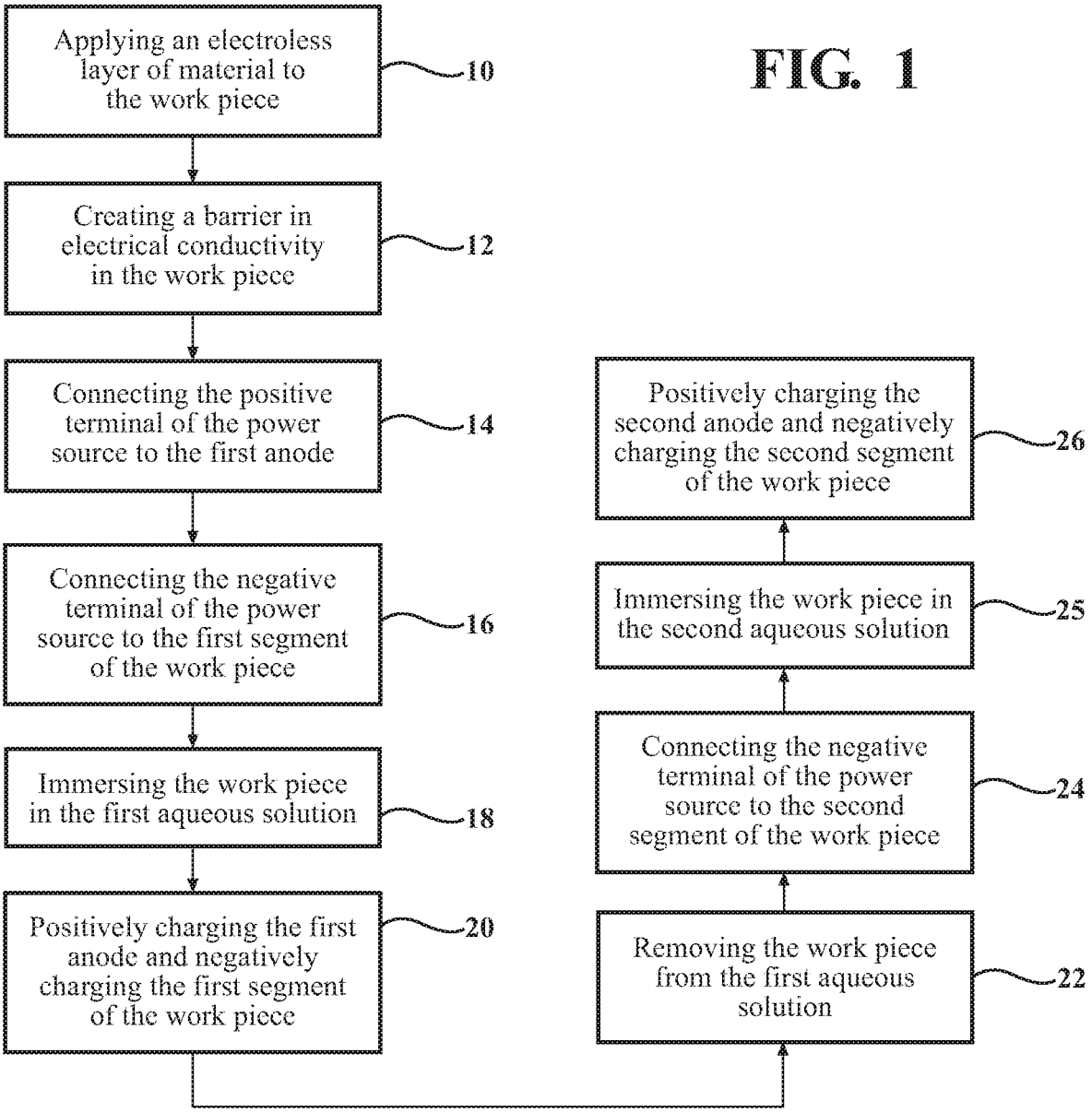
FIG. 1 is flow diagram of a method of plating a work piece in accordance with an aspect of the disclosure.

Referring to the Figures, wherein like numerals indicate corresponding parts throughout the several views, a method is generally shown for plating a work piece 100 using a power source 102 (e.g., a battery) having a positive terminal 104 and a negative terminal 106. It will be appreciated that a variety of suitable power sources may be employed. According to an aspect, the work piece 100 may be configured as a trim component for a vehicle such as a grill, wheel cover or interior trip piece. It will be appreciated that the work piece 100 may be for a variety of different applications, including for furniture applications.

According to an aspect, as exemplarily shown in FIGS. 1-4, the method includes creating a barrier 114 to electrical conductivity in a base substrate layer 110 of the work piece 100. Thereafter, an electroless layer of material 108 can be applied to the base substrate layer 110 of the work piece 100 using an electroless plating process, as generally indicated by reference number 10. As known in the art, the electroless plating process generally includes an autocatalytic chemical reaction which causes a metal to be deposited on the base substrate layer 110 of the work piece 100 such that the substrate layer 110 will be conductive. According to an aspect, the electroless layer of material 108 can act as a base layer that has good adherence to both the substrate layer 110 of the work piece 100 as well as to a subsequently plated electroplated layer 124, 132, as described illustratively below. Therefore, once the electroless layer of material 108 is adhered to the base substrate layer 110 of the work piece 100, the work piece 100 may be well-suited for receiving subsequent electroplated layers thereon. It should be appreciated that suitable metals for plating (both electroless plating and electroplating) according to the subject method may include, but are not limited to, copper, nickel, zinc, palladium, gold, cobalt, chromium (i.e., chrome), and alloys thereof. Furthermore, the material of the substrate layer 110 of the work piece 100 in accordance with an aspect may be plastic, but other suitable materials for both the metal layers and the substrate could be used without departing from the scope of the subject disclosure. According to another aspect, a non-conductive base substrate layer 110, such as a non-conductive plastic, may be rendered conductive in a variety of other suitable ways. For example, the work piece 100 may include or be formed of a conductive plastic. It will be appreciated that the base substrate and/or the work piece may be formed via an injection molding process. According to a further aspect, a conductive paint may be applied over the base substrate layer 110 such that the part is suitable for receiving subsequent electroplated layers thereon.

According to an aspect, the method can also include creating a barrier 114, 214, 314 in electrical conductivity in the work piece 100 to divide the work piece 100 into a first segment 116 and a second segment 118, with the first and second segments 116, 118 substantially electrically insulated from one another, as generally indicated by reference number 12. As a result, a current may flow through each respective first and second segment 116, 118 without flowing through the other.

Figure 2:
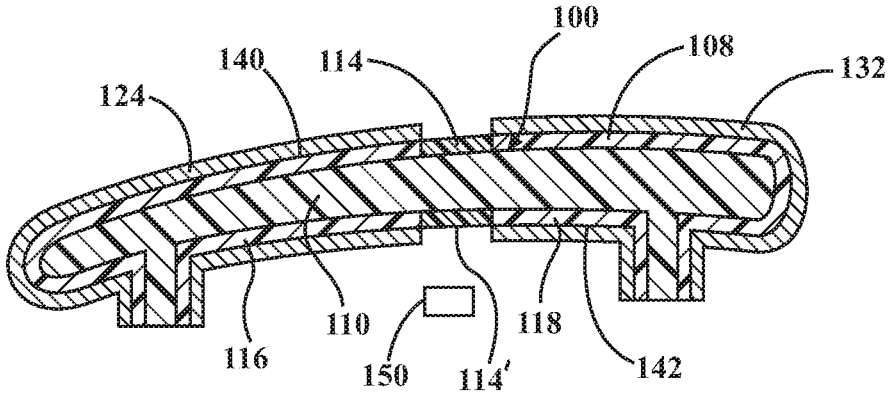
FIG. 2 is a side cross-sectional view of a work piece having a barrier formed thereon in accordance with an aspect of the disclosure.

According to an aspect and as exemplarily shown in FIG. 2, a barrier 114 in electrical conductivity in the work piece 100 may be created, formed or disposed on the base substrate layer 110 prior to application of the electroless layer of material 108 to the work piece 100. According to an aspect, the step of creating a barrier 114 in the work piece 100 may include applying a plating resistant coating on the work piece to define the barrier 114 so as to substantially prevent the subsequent deposition of the electroless layer of material 108 on the barrier 114. The plating resist coating 114 may include a non-plateable plastic resin that may be applied to the surface. The plating resist coating may be a polyvinyl chloride material, a polycarbonate material or the like that is applied to the substrate, such as by painting. It will be appreciated that this material should substantially prevent the electroless layer of material 108 from being formed on areas of the base substrate layer 110 that are insulated from the area to which current is applied. It will also be appreciated that a variety of other suitable materials which resist plating may be employed. Such a material may vary depending on what kind of metal is being applied thereon by way of the electroless plating process. It should be appreciated that since the area of the barrier 114 is unable to receive the electroless layer of material 108, after the electroless layer of material 108 is applied on the remaining portions of the work piece 100, the first and second segments 116, 118 of the work piece 100 may each be configured as respective electrical circuits that are isolated from the other. As shown in FIG. 2, according to an aspect, the barrier 114 may be formed on both a front surface 140 and a back surface 142 of the work piece 100 to ensure that they are electrically isolated from one another so long as current between the sections is isolated. While the barrier 114' is illustrated as disposed opposite the barrier 114, it will be appreciated that they can be offset.

Figure 3:
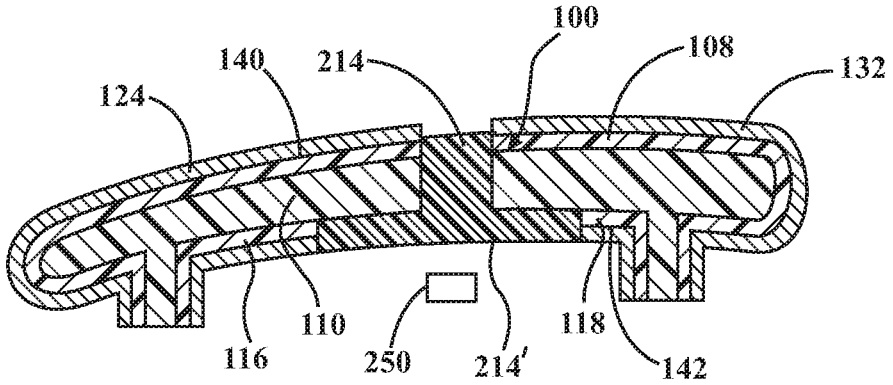
FIG. 3 is a side cross-sectional view of a work piece having a barrier formed thereon in accordance with another aspect of the disclosure.

According to another aspect as exemplarily shown in FIG. 3, a barrier 214 in electrical conductivity in the work piece 100 may be created, formed or disposed on the base substrate layer 110 prior to application of an electroless layer of material 108 to the work piece 100. According to a further aspect, the step of creating a barrier 214 in the work piece 100 may include molding a non-plateable material 214 into or onto the work piece 100 to define the barrier 214 so as to substantially prevent the deposition of the electroless layer of material 108 on the barrier 214. Like the plating resistant coating 114, the non-plateable material 214 may include a non-plateable plastic resin including, but not limited to, a polyvinyl chloride material, a polycarbonate material or the like. Again, this material should substantially prevent the electroless layer of metal from being formed thereon. According to this aspect, the molding process for creating this layer may include a multi-shot injection molding process, a transfer molding process, an over-molding process or the like. It will be appreciated that a variety of other suitable molding processes may be employed. Again, it should be appreciated that since the area of the barrier 214 is unable to receive the electroless layer of material 108, after the electroless layer of material 108 is applied on the remaining portions of the work piece 100, the first and second segments 116, 118 of the work piece 100 may each function as respective electrical circuits that are isolated from one another. As shown in FIG. 3, according to an aspect, the barrier 214 may be formed on both a front surface 140 and a back surface 142 of the work piece 100 to ensure that they are electrically isolated from one another. While the barrier 214' is illustrated as disposed opposite the barrier 214, it will be appreciated that they can be offset so long as current between the sections is isolated. Additionally, as shown, the barrier 214' may be larger in size and take up more of the back side 142 surface.

Figure 4:
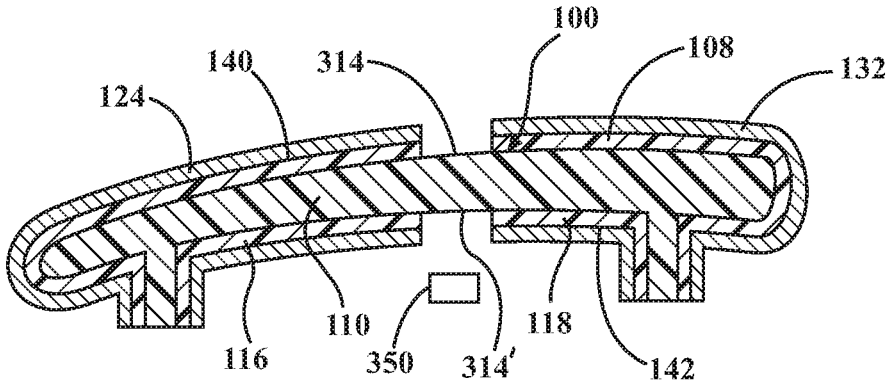
FIG. 4 is a side cross-sectional view of a work piece having a barrier formed thereon in accordance with a further aspect of the disclosure.

According to a further aspect as exemplarily shown in FIG. 4, the step of creating a barrier 314 in electrical conductivity in the work piece 100 can alternately occur after the electroless layer of material 108 has been applied, and may include removing a portion of the electroless layer of material 108 to define the barrier 314 in electrical conductivity. When the electroless layer of material 108 is removed to create the barrier 314 subsequent electroplated layers will not deposit due to the non-conducting surface under the electroless layer, making the first and second segments 114, 116 of the work piece 100 function as respective, isolated, electrical circuits. The barrier segment of the electroless layer of material 108 may be removed by a mechanical mechanism, chemical dissolution or the like. It will be appreciated that a variety of other suitable removing process may be employed. As shown in FIG. 4, according to an aspect, the barrier 314 may be formed on both a front surface 140 and a back surface 142 of the work piece 100 to ensure that they are electrically isolated from one another. While the barrier 314' is illustrated as disposed opposite the barrier 314, it will be appreciated that they can be offset so long as current between the sections isolated.

It should be appreciated that any combination of the aforementioned methods may be used to create the barrier 314 in electrical conductivity. According to an aspect, the barrier 314 on the front surface can be formed utilizing one method and the barrier 314' on the back surface can be formed utilizing another method. For example, the barrier 314 on the front surface can be formed via an injection molding method utilizing a material that is resistant to plating and the barrier 314' on the back surface can be formed utilizing a spray resist coating. It will be appreciated that a variety of other suitable ways may be employed to create barriers to electrical conductivity.

Figure 5:
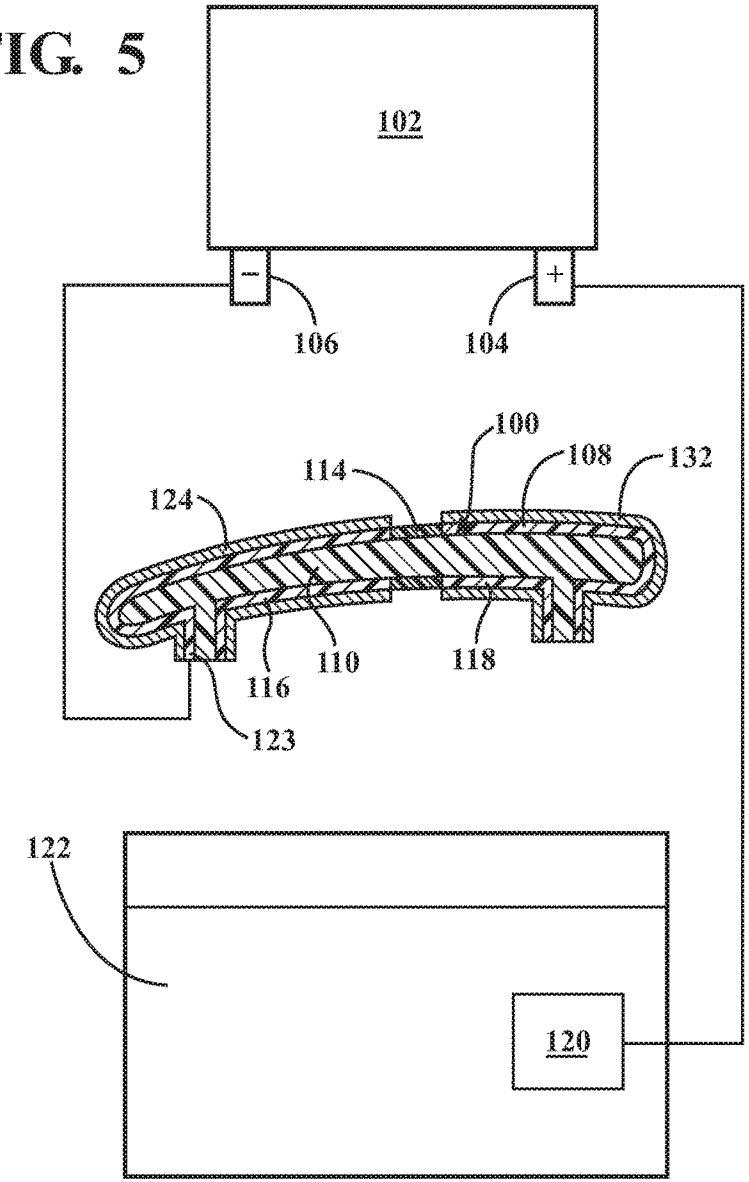
FIG. 5 is a side cross-sectional view of a power source, a first aqueous solution, a first anode and a work piece in accordance with an aspect of the disclosure.

According to an aspect, as shown FIGS. 1 and 5, the method may proceed with the step of connecting the positive terminal 104 of the power source 102 to a first anode 120, as generally indicated by reference number 14. The first anode 120 may be made of a metal material and may be placed in a first aqueous solution 122 with current being applied to the first anode 120. The first anode 120 may be soluble, where the material will dissolve into a first aqueous solution 122 as current is passed through it or insoluble, where the anode material will not dissolve into the solution as current is applied therethrough. It will be appreciated that the first anode 120 could be constructed of a metal material, which may include, but is not limited to, copper, nickel, zinc, palladium, gold, cobalt, chromium (i.e., chrome), and alloys thereof. According to an aspect, the metal material from the first anode 120 may be used directly for plating purposes on the work piece 100. Alternatively, the plating to the work piece 100 can occur from the metal ions available in the first aqueous solution 122, as will be understood by one of ordinary skill in the art. The first anode 120 may be in the form of a solid mass of material that is insoluble or soluble, while the plating solution is composed of a plurality of metal salts necessary to achieve the desired plated layer.

According to aspect, the method proceeds with connecting the negative terminal 106 of the power source 102 to a first point of contact 123 on the first segment 116 of the work piece 100, as generally indicated by reference number 16. The work piece 100 may then be immersed in the first aqueous plating solution 122 which may contain metal salts and the first anode 120, as generally indicated by reference number 20. After the work piece 100 has been immersed in the first aqueous solution 122, the method can proceed with 20 positively charging the first anode 120 and negatively charging the first segment 116 of the work piece 100 to cause the metal ions in the first aqueous solution 122, to be reduced to their metallic state at the solution interface of the first segment 116. A layer of metal may then form on the first segment 116 because it is the only location on the work piece 100 that has a supply of electrons to reduce the metal salts to their respective metal state (i.e., $Cu^{2+}+2e \rightarrow Cu^{0}$). Because there is no supply of electrons on the second segment 118 (since it is electrically isolated), metal ions in the first aqueous solution 122 cannot be reduced to their metallic state.

Figure 6:
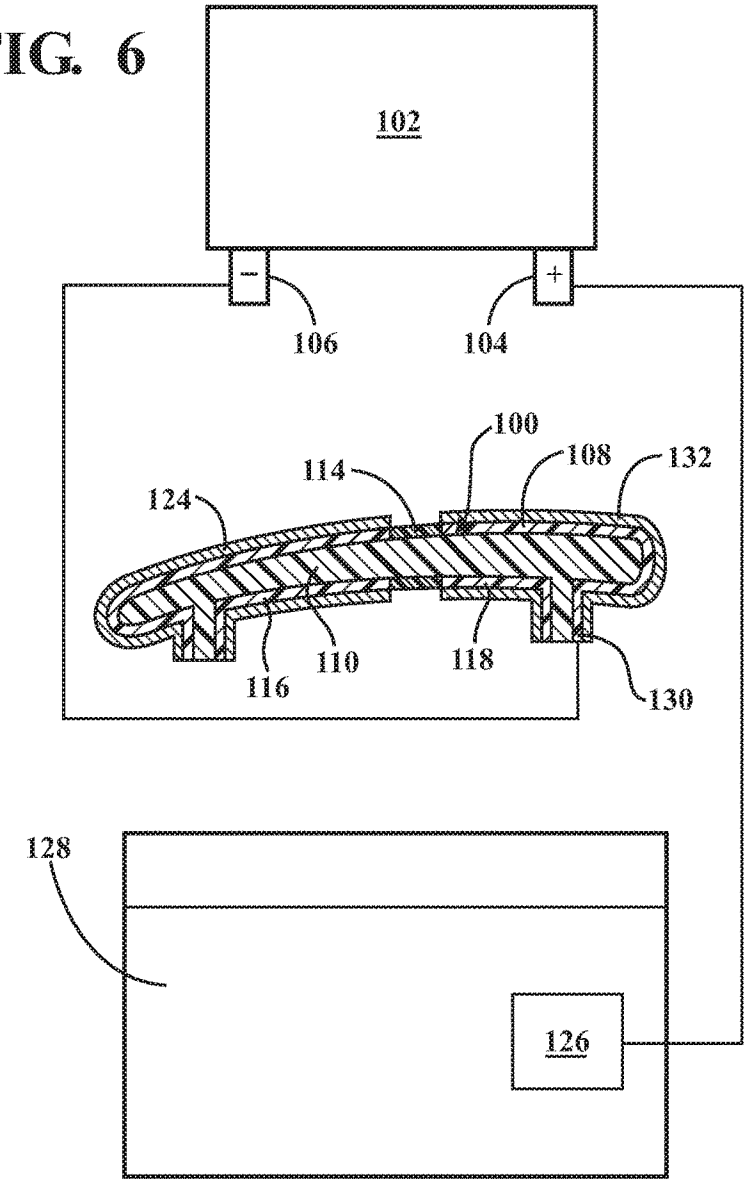
FIG. 6 is a side cross-sectional view of a power source, a second aqueous solution, a second anode and a work piece in accordance with an aspect of the disclosure.

According to another aspect, as shown in FIGS. 1 and 6, the method can then continue with the step of removing the work piece 100 from the first aqueous solution 122 and connecting the positive terminal 104 of the power source 102 to a second anode 126, as generally indicated by reference number 22. Similar to the first anode 120, the second anode 126 may be made of a metal material Also, like the first anode 120, the metal material from which the second anode 126 can be comprised may include, but is not limited to, nickel, zinc, palladium, gold, cobalt, chromium (i.e., chrome), and alloys thereof. It will be appreciated that a variety of other suitable materials may also be employed. According to an aspect, the second anode 126 may be of a different metal than the metal of the first anode 120. Also like the first anode 120, the second anode 126 may be in the form of a solid mass of material that is insoluble or soluble, while the plating solution is composed of a plurality of metal salts necessary to achieve the desired plated layer 128. It will be appreciated that different metal finishes can also be achieved utilizing the same anodes such as for example with a Bright Chrome part and a Satin Chrome part.

According to a further aspect, the method can then proceed with connecting the negative terminal 106 of the power source 102 to a second point of contact 130 on the second segment 118 of the work piece 100, as generally indicated by reference number 24. The work piece 100 may then be immersed in the second aqueous solution 128 which contains the second anode 126, as generally indicated by reference number 25. After the work piece 100 has been immersed in the second aqueous solution 128, the method can continue with positively charging the second anode 126 and negatively charging the second segment 118 of the work piece 100 to cause metal ions from the second plating solution 126 to be passed onto the electroless layer 108 on the second segment 118 of the work piece 100 to form a second electroplated layer 132 on the second segment 118, as generally indicated by reference number 26. It should be appreciated that a metal layer only forms on the second segment 118 of the work piece 100 because the first and second segments 116, 118 are electrically insulated from one another by the barrier 114, 214, 314.

As a result of the aforementioned steps, after the second electroplated layer 132 of metal has been formed on the second segment 118 of the work piece 100, the first and second segments 116, 118 have different metallic finishes. It should further be appreciated that additional barriers 114, 214, 314 in conductivity could be made on the work piece 100 to provide additional segments that are electrically insulated from one another. Such additional segments could be electroplated in accordance with the aforementioned steps to provide for more than two segments of the work piece 100 that have different metallic finishes.

According to a still further aspect, to improve adherence of the first and second electroplated layers 124, 132 to the work piece 100 and to improve the structural properties of the work piece 100, an intermediate electrolytic layer of copper from an acid copper plating solution may be applied to both the first and second segments 116, 118 after the electroless layer of material 108 is applied to the work piece 100, and prior to electroplating the first and second electroplated layers 124, 132 as described above. Applying this intermediate layer can build the metal thickness to a level that is sufficient to carry the current for electroplating of subsequent metal layers. After the intermediate copper layer has been electrodeposited to a sufficient thickness, an intermediate layer of sulfur-free nickel may be electroplated onto the copper surface to protect the copper from corrosion on all electrical pathways on the part. After the deposition of the intermediate layer of sulfur-free nickel is electroplated on the work piece, there can be a significant amount of metal to carry current, and the copper layer is protected. Therefore, the work piece 100 can be immersed in any suitable plating solution and electroplated as described above to provide the first and second electroplated layers 124, 132 to achieve the desired finishing effect. It should be appreciated that the method could alternatively proceed without these steps and other materials could be used in these steps in place of those described. It will additionally be appreciated that intermediate layers consisting of different materials could be applied to the first and second segments 116, 118 to provide different appearances for the work piece 100.

According to a further aspect of the present disclosure, after a barrier 114, 214, 314 is created as described above to electrically isolate multiple sections of a work piece 100, an electrophoretic coating may be selectively deposited on at least one of the sections of the work piece 100 in order to create different aesthetic affects. It will be appreciated that the deposition of the electrophoretic coating may occur in connection with the deposition of one or more different metal layers as discussed above. It will be appreciated that different electrophoretic coatings may be selectively deposited in the same fashion discussed above such that one electrophoretic coating may be applied to one section of a part without it being applied to another section of the part.

According to a still further aspect of the present disclosure, as the barriers can be formed on both the front side 140 and the back side 142 of the work piece 100, metal layers are not deposited thereon, as discussed above. As shown in the Figures, a light source 150, 250, 350 may be disposed behind the work piece 100 and positioned to emit light into the barriers to provide a backlighting effect, as shown, to enhance aesthetics. It will be appreciated that the use of a transparent or translucent material at the barrier can assist with this effect, although non-translucent or non-transparent materials may also be employed. Alternatively, the work piece 100 may be formed of resins of different colors to provide additional aesthetic affects.

Figure 7:
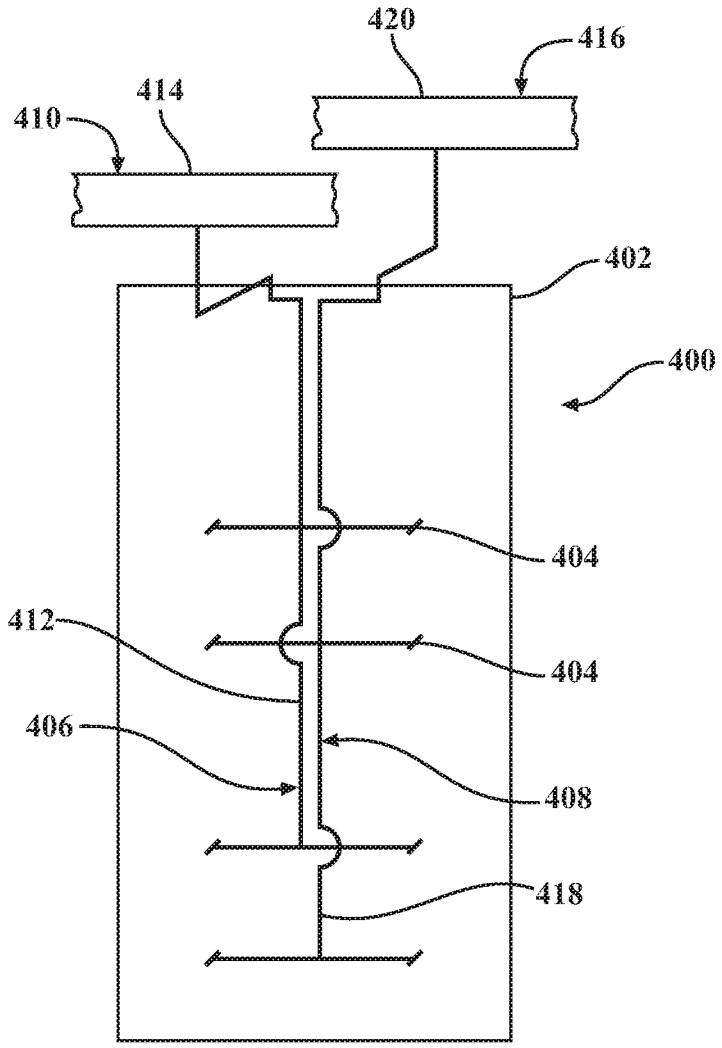
FIG. 7 is a schematic illustration of a plating tool for use in plating a work piece in accordance with an aspect of the disclosure.

FIG. 7 illustrates a plating tool 400 in accordance with an aspect of the disclosure. As shown, the tool 400 can include a plating rack 402 with a plurality of rack tabs 404, which are configured to hold individual work pieces that are to be subjected to a plating process. According to an aspect, the plating tool 400 can include multiple current pathways, which may be referred to as a first circuit 406 and a second circuit 408. Each of the first circuit 406 and the second circuit 408 can be selectively actuated such that each of the circuits can be active at separate times as desired. According to another aspect, the first circuit 406 can be configured such that it is in communication with a first segment 116 of the work pieces 100 located on the rack tabs 404 of the plating rack 402 such that current is applied thereto to effectuate plating a metal layer onto the first segment 116. This allows for first segments of multiple work pieces to be subjected to a plating process simultaneously. According to a further aspect, the second circuit 408 can be configured such that it is in communication with a second segment 118 of the work pieces 100 located on the rack tabs 404 of the plating rack 402 such that current is applied thereto to effectuate plating of a separate metal layer onto the second segment 118. This allows for second segments of multiple work pieces to be subjected to a plating process simultaneously. It will be appreciated to more than two circuits can be integrated into the plating rack 402 to accommodate plating multiple different metal layers onto a surface of the work piece 100.

According to an aspect, the first circuit 406 can include a first power source 410, a first cathode 412 and a first connector bushing 414. The first power source 410 can provide power to the first cathode 412 to charge at least a portion of one or more work pieces. The first power source 410 may be in communication with the first cathode 412 via the first connector bushing 414. According to a further aspect, the first cathode 412 may be integrated into the plating rack 402. According to a still further aspect, the second circuit 408 can include a second power source 416, a second cathode 418, and a second connector bushing 420. The second power source 416 can provide power to the second cathode 418 to charge at least a portion of one or more work pieces. The second power source 416 may be in communication with the second cathode 418 via the second connector bushing 420. The second cathode 418 may also be integrated into the plating rack 402.

According to an aspect, each of the circuits 406, 408 may be electrically insulated from each other. Additionally, each of the circuits 406, 408 can connect to separate power sources such that each of the circuits can be activated individually or simultaneously as desired. The use of separate circuits allows for the plating of different metals on a single work piece. According to a further aspect, the plating rack 402 may be coated with a plate resistant coating to prevent rack plate-up as well as rack damage. The plate resistant coating may be Platisol, however, a variety of other suitable coatings may be employed.

It will also be appreciated that an auxiliary anode may also be incorporated into the tooling to assist in the deposition of metal in areas where the electrical current density is limited, such as recessed areas.

As described above, the work piece 100 may have separate segments 116 and 118 that are electrically isolated relative to each other. In one aspect, multiple layers of material may be applied via an electroplating process. These multiple layers of material may be applied to one of the segments 116 or 118. For example, multiple layers of material may be applied to the first segment 116. Additionally, multiple layers of material may be applied to the second segment 118. The segments 116 and 118 may be plated separately, by removing the work piece 100 from the first aqueous solution 122 and then placing the work piece 100 in the second aqueous solution 128. In another aspect, the work piece 100 may remain immersed in the first aqueous solution 122, and the first segment 116 may be plated by running a current through the first circuit 406 at a first time, and then the second segment may be plated by running a current through the second circuit 408 at a second time without removing the work piece 100 from the first aqueous solution 122. It will be appreciated that the first aqueous solution 122 is used for both segments 116, 118, and the first aqueous solution 122 is not limited for use with the first segment 116.

The above description has referred to a first circuit 406 and a second circuit 408. However, it will be appreciated that there may be more than two separate circuits, and that the use of multiple circuits is not limited to two.

In one aspect, multiple separate circuits may be attached to the first segment 116, to allow for plating multiple layers of material on the first segment 116 using multiple rectification sources. In one aspect, a first layer of a first metal material may be applied to the first segment 116 via a first circuit via a first rectification source, and a second layer of a second metal material may be applied to the first segment 116 via a second circuit via a second rectification source.

In one aspect, the plating process can include applying a first current via a first circuit that includes the first segment 116, and the plating process further includes applying a second current via a second circuit that includes the second segment 118. The plating process may include creating a first metal surface on the first segment 116 that includes a plurality of first metal layers. The plating process may include creating a second metal surface on the second segment 118 that includes a plurality of second metal layers.

In one aspect, the first current and the second current are applied simultaneously to the first and second metal surfaces such that at least one of the first metal layers and at least one of the second metal layers are deposited on the work piece 100 at the same time. In one aspect, the work piece 100 remains within the same aqueous solution as the first and second currents are applied.

In one aspect, the first circuit 406 is connected to the first power source 410, and the second circuit 408 is connected to the second power source 416. The first and second power sources 410, 416 may be activated simultaneously, as described above. When activated simultaneously, common metal layers may be applied to the first segment 116 and second segment 118 at the same time. The first and second power sources 410, 416 may also be activated individually. When activated individually, metal layers may be applied to the first segment 116 and second segment 118 at different times such as sequentially.

In one aspect, the first segment 116 may be part of a circuit that includes the first power source 410 and may also be part of a circuit that includes the second power source 416. Accordingly, when the first power source 410 is activated, a first metal layer of a first type may be applied to the first segment 116, and when the second power source 416 is activated, a second metal layer of a second type may be applied to the first segment 116. Similarly, the second segment 118 may be part of a circuit with both the first power source 410 and the second power source 416.

The use of separate power sources and separate rectifiers therefore allows for different types of metal layers to be applied easily and efficiently without requiring removal of the work piece 100 from the solution in which it is disposed. The work piece 100 need not be removed and placed in a different solution and connected to a different circuit. The segments 116 and/or 118 may be attached to multiple circuits, and selective activation of the rectifiers may be used to control which segment is plated and/or which type of surface finish is applied, depending on the circuit that activated.

As stated above, different metal finishes may be achieved utilizing the same anodes. For example, a bright chrome finish may be achieved using the same anode that produces a satin chrome finish by utilizing different rectifiers and different circuits.

Thus, in one aspect, the first and second metal surfaces created on the work piece 100 have the same base metal. The base metal may be disposed in the first aqueous solution 122 in which the work piece 100 is disposed. The first metal surface may be bright chrome, and the second metal surface may be a different metal surface having the same base metal as bright chrome (e.g. satin chrome).

The first segment 116 may be part of a first circuit that includes the first power source 410, and the second segment 118 may be part of a second circuit that includes the second power source 416. The work piece 100 and both the first segment 116 and the second segment 118 may be disposed in the first aqueous solution 122 that includes the same base metal for creating a bright chrome and/or satin chrome and/or other finish arising from the same base metal. The first and second power sources 410 and 416 may be activated simultaneously, sequentially, or during an overlapping period of time. The first segment 116, being electrically isolated from the second segment 118, will receive one type of surface finish according to the first power source 410. The second segment 118, being electrically isolated from the first segment 116, will receive a different type of surface finish according to the second power source 416. These different surface finishes may be achieved without removing the work piece 100 from the first aqueous solution 122.

In one aspect the first segment 116 may be part of a first circuit that includes the first power source 410. The first segment 116 may also be part of a second circuit that includes the second power source 416. The work piece 100 maybe disposed in the first aqueous solution 122 that includes the same base metal. The first circuit may be activated to produce a first type of metal layer on the first segment 116 from the base metal of the solution 122. The second circuit may then be activated to produce a second type of metal layer on the first segment 116 from the base metal of the solution 122.

Obviously, many modifications and variations of the present disclosure are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A method of creating a component having different first and second decorative surface finishes defined by a first plurality of metal layers and a second plurality of metal layers, comprising:

forming a plastic work piece of a first material;

creating at least one barrier in electrical conductivity in the work piece to divide the work piece into multiple electrically isolated segments including a first segment and a second segment;

connecting a first segment of the work piece to a first circuit including a first power source and a first rectifier;

connecting a second segment of the work piece to a second circuit including a second power source and a second rectifier, wherein the second power source and second rectifier is separate from the first power source and first rectifier such that the first and second power sources define multiple separate and different power sources and rectifiers that are activatable simultaneously, sequentially, and during overlapping time periods, wherein the first and second circuits are connected, respectively, to the first and second segments of the same work piece at the same time;

depositing at least one first metal layer of the first plurality of metal layers of the work piece on the first segment via a plating process;

depositing at least one second metal layer of the second plurality of metal layers of the work piece on the second segment via a plating process;

depositing an additional metal layer of the first plurality of metal layers on the first segment and depositing an additional metal layer of second plurality of metal layers on the second segment such that the first and second decorative surface finishes of the work piece have different surface finishes and appearances that are not the same, wherein the additional metal layers of the first plurality of metal layers and the second plurality of metal layers define the different surface finishes and appearances and are achieved using a same base metal by utilizing the different circuits and different rectifiers.

2. The method of claim 1, further comprising immersing the first and second segments in a common solution of the same base metal prior to creating the first and second metal surface finishes.

3. The method of claim 1, wherein the first and second metal surface finishes are created simultaneously from a common solution of the same base metal.

4. The method of claim 1, wherein the first and second metal surface finishes are created sequentially from a common solution of the same base metal.

5. The method of claim 2, wherein the work piece remains in the common solution during the creation of the first and second metal surfaces using the multiple power sources.

6. The method of claim 1, wherein the first power source and first rectifier applies a first current that produces a first type of surface finish from the same base metal and the second power source and second rectifier applies a second current with different current properties than the first current that produces a second type of surface finish having a different appearance than the first type of surface finish, wherein the type of finish is different and dependent on the circuit being activated.

7. The method of claim 1, further comprising applying an electroless layer of material to the first and second segments of the work piece and rendering the first and second segments conductive.

8. The method of claim 7, further comprising creating a non-plateable barrier between the first and second segments of the work piece.

9. A method of creating an automotive trim component having multiple decorative surface finishes having different appearances, comprising:

forming a plastic work piece;

rendering a first segment and a second segment of the work piece conductive, wherein the first and second segments are electrically isolated relative to each other;

creating a first metal surface finish on the first segment of the plastic work piece through an electroplating process that includes applying a first current via a first circuit that includes the first segment;

creating a second metal surface finish on the second segment of the plastic work piece through an electroplating process that includes applying a second current via a second circuit that includes the second segment;

wherein the first metal surface finish and the second metal surface finish each include at least one common layer formed of the same metal material and same finish;

wherein the first and second current are applied simultaneously to create the at least one common layer of the first and second metal surface finishes simultaneously using multiple power sources and rectifiers;

wherein the first and second metal surface finishes are different chrome finishes having at least one uncommon layer in addition to the at least one common layer defining different gloss levels and different appearances and are achieved from a same base metal using the same anode that produces the different gloss levels by utilizing different rectifiers and different circuits.

10. The method of claim 9, wherein the first circuit includes a first power source and first rectifier of the multiple power sources and rectifiers and the second circuit includes a second power source and second rectifier of the multiple power sources and rectifiers.

11. The method of claim 9, wherein the first metal surface finish is Bright Chrome and the second metal surface finish is different whereby the work piece has multiple different surface appearances achieved from the same base metal.

12. The method of claim 9, wherein the work piece and the first and second segments are immersed in a common solution of the same base metal during the creation of the first and second surface finishes.

13. The method of claim 9, wherein the first and second currents are different such that the current properties are different, and the type of surface finish is different and dependent on the circuit being activated.

14. The method of claim 9, wherein the first circuit is connected to a different rectifier than the second circuit.

15. The method of claim 9, wherein the first metal surface finish includes multiple metal layers and the second metal surface finish includes multiple metal layers.

16. The method of claim 9, further comprising immersing the work piece and the first and second segments in a common solution having the same base metal, wherein the first and second metal surface finishes having different appearances are created without removing the work piece from the common solution during the creation of the first and second metal surfaces.

17. The method of claim 9, further comprising forming at least one barrier in electrical conductivity in the work piece to divide the work piece into the first and second segments.

18. The method of claim 17, wherein the at least one barrier is formed of a material that substantially prevents an electroless layer of material being formed thereon, and the step of rendering the first and second segments conductive includes applying an electroless layer of material on the first segment and the second segment.

19. The method of claim 1, wherein the first segment is further connected at the same time to an additional circuit including an additional power source and additional rectifier, wherein the first circuit is activated to produce a first type of metal layer on the first segment and the additional circuit is activated to produce a second type of metal layer, wherein the first and second types are produced from the same base metal and dependent on the circuit being activated.

20. The method of claim 9, wherein the first segment is further connected at the same time to an additional circuit including an additional power source and additional rectifier, wherein the first circuit is activated to produce a first type of metal layer on the first segment and the additional circuit is activated to produce a second type of metal layer, wherein the first and second types are produced from the same base metal and dependent on the circuit being activated.

* * * * *